United States Patent [19]

Lorraine

[11] Patent Number: 5,056,489

[45] Date of Patent: Oct. 15, 1991

[54] FUEL RAIL FOR V-TYPE ENGINE

[75] Inventor: Jack R. Lorraine, Newport News, Va.

[73] Assignee: Siemens-Bendix Automotive Electronics L.P., Troy, Mich.

[21] Appl. No.: 377,678

[22] Filed: Jul. 10, 1989

[51] Int. Cl.[5] ..... F02M 39/00

[52] U.S. Cl. ..... 123/468; 123/469; 123/456; 138/115

[58] Field of Search ..... 123/468, 469, 470, 471, 123/472, 456; 138/115, 116, 111

[56] References Cited

U.S. PATENT DOCUMENTS

| | | | |
|---|---|---|---|
| 4,519,368 | 5/1985 | Hudson | 123/468 |
| 4,586,477 | 5/1986 | Field | 123/468 |
| 4,601,275 | 7/1986 | Weinand | 123/468 |
| 4,756,289 | 7/1988 | Rock | 123/468 |
| 4,798,187 | 1/1989 | Hudson | 123/469 |

FOREIGN PATENT DOCUMENTS

| | | | |
|---|---|---|---|
| 823864 | 12/1951 | Fed. Rep. of Germany | 128/115 |
| 490678 | 2/1954 | Italy | 138/116 |

*Primary Examiner*—Carl Stuart Miller

*Attorney, Agent, or Firm*—George L. Boller; Russel C. Wells

[57] ABSTRACT

A fuel rail for an engine fuel injection system comprises a pair of main tubes on opposite sides of the engine. A baffle is disposed within each main tube, dividing the tube into first and second flow channels. Injectors are fed from the first flow channels. A pair of closely adjacent transverse tubes intercept the main tubes at one end of the main tubes. One transverse tube introduces fuel into the first flow channel of each main tube. The fuel flows through these channels and returns via the second flow channels. The other transverse tube carries return fuel from one main tube to the other main tube where it joins the return flow from the other main tube and the flows enter a pressure regulator. The one main tube contains a twist in its baffle so that its injectors are properly communicated to the inlet fuel entering via the one transverse tube.

31 Claims, 3 Drawing Sheets

FUEL RAIL FOR V-TYPE ENGINE

BACKGROUND AND SUMMARY OF THE INVENTION

This invention relates to a fuel rail that is used in a fuel injection system for an internal combustion engine. More specifically, the invention relates to a new and unique construction for a fuel rail that has particular utility in connection with a V-type engine.

In a V-type engine there are two banks of cylinders on opposite sides of the engine block. When this type of an engine is equipped with a fuel injection system where an individual injector is assigned to each cylinder, fuel is distributed to the injectors by means of a fuel rail. An example of a fuel rail that is adapted to serve a V-type engine is illustrated in U.S. Pat. No. 4,286,531 issued Sept. 1, 1981 and commonly assigned. The fuel rail of that patent comprises two main branches, one serving one side of the engine and the other serving the cylinders on the opposite side of the engine. The branches share a common inlet and a common outlet, and the direction of flow is the same through each branch between inlet and outlet. The inlet is located in the vicinity of one corner of the engine while the outlet is located in the diagonally opposite corner.

The present invention relates to a new and unique construction for a fuel rail, particularly for a V-type engine, which enables the fuel inlet and the fuel outlet to be located at one corner of the engine while only a single tube is disposed along each side of the engine. The invention, in the preferred embodiment, features the use of baffles disposed within circular main tubes that extend along the two sides of the engine. Each baffle divides the corresponding main tube into two flow channels. In each main tube fuel flows in one direction through one channel and then in the opposite direction through the other channel. One of a pair of side by side transversely extending tubes communicates the upstream ends of corresponding flow channels in each main tube while the second transversely extending tube communicates the downstream ends of the other flow channels of the two main tubes. The fuel inlet is teed into the first transverse tube immediately adjacent one main tube while the downstream ends of said other flow channels lead to a base for mounting the fuel pressure regulator and containing the fuel return outlet from the fuel rail. The main tube that contains the pressure regulator mounting base has a twist in its baffle that provides for the proper communication of the two transverse tubes with its flow channels.

The foregoing features, advantages and benefits of the invention, along with additional ones, will be seen in the ensuing description and claims which should be considered in conjunction with the accompanying drawings. The drawings disclose a presently preferred exemplary embodiment of the invention in accordance with the best mode contemplated at the present time in carrying out the invention.

BRIEF DESCRIPTION OF THE DRAWINGS

FIG. 3 is a baffle that is used in one of the main tubes of the fuel rail, a portion of the baffle being sectioned away.

FIG. 6 is a view of a baffle that is used in the other main tube of the fuel rail, a portion of the baffle being sectioned away.

DESCRIPTION OF THE PREFERRED EMBODIMENT

Figure 1:
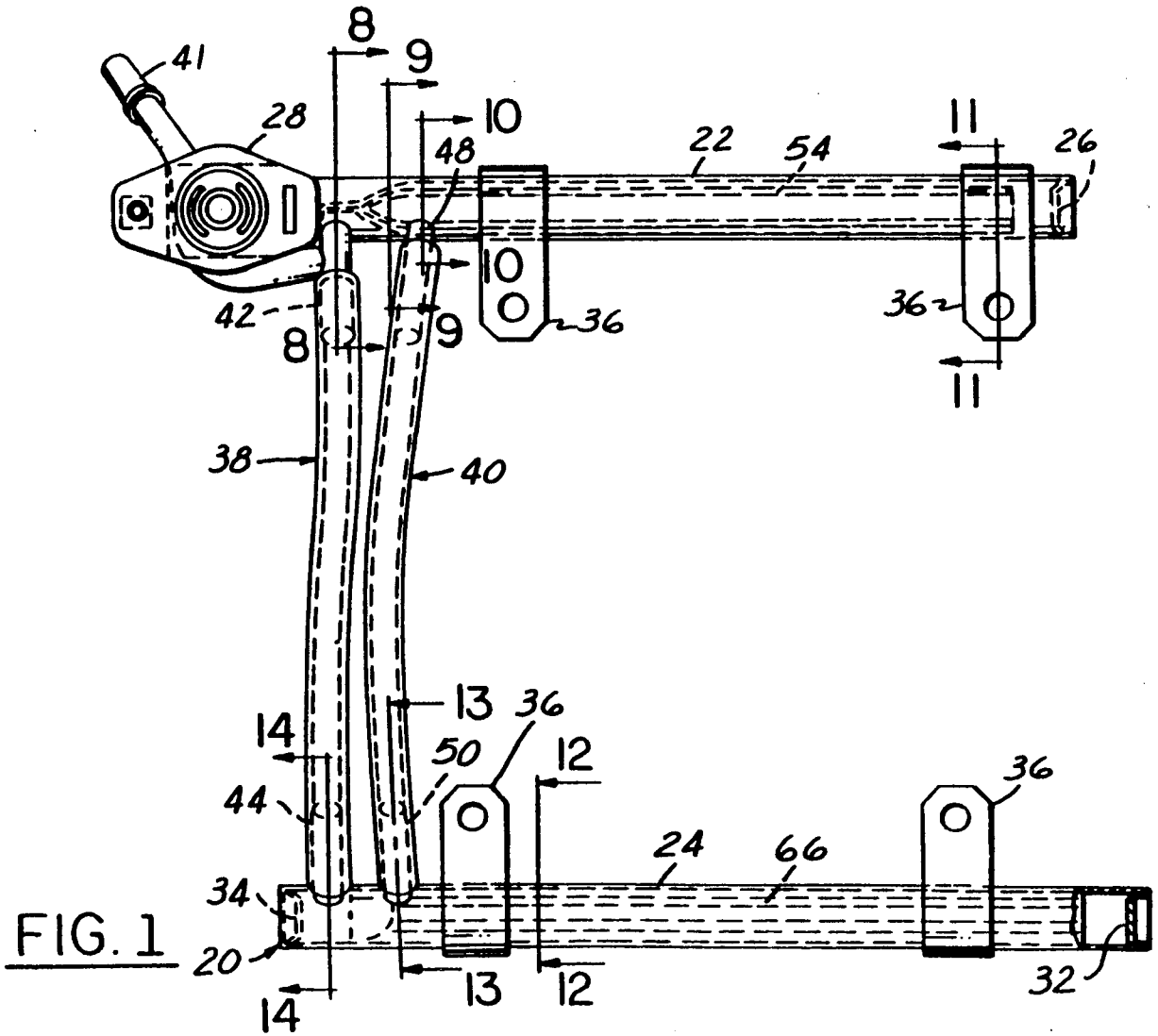
FIG. 1 is a top plan view of a fuel rail embodying principles of the present invention.
Figure 2:
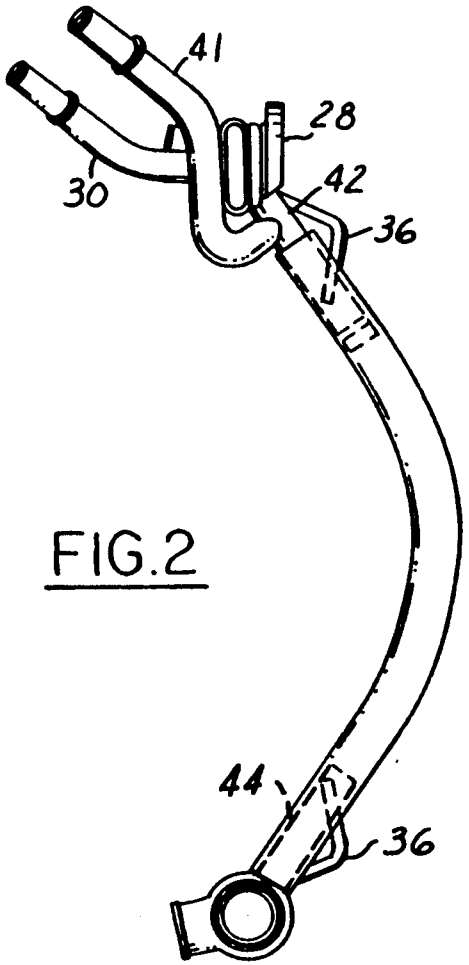
FIG. 2 is a front elevational view of the fuel rail assembly of FIG. 1.

The fuel rail 20 comprises one main metal tube 22 that serves the cylinders on one side of the engine and a second main metal tube 24 that serves the cylinders on the opposite side of the engine. Tube 22 is straight and of circular cross-section throughout. The right-hand end as viewed in FIG. 1 is closed by means of a cap 26 while the left-hand end as viewed in FIG. 1 is in communication with the inlet to the base 28 for a fuel pressure regulator. The portion of the fuel pressure regulator above base 28 is not shown in the drawing figures but is of a conventional, well-known construction. The outlet from base 28 is in communication with an outlet return tube 30 that serves to convey excess fuel back to a fuel tank (not shown).

Tube 24 is straight and of circular cross-section throughout. It is closed at its opposite end by caps 32 and 34. Four mounting brackets 36, two attached to each tube 22, 24, serve to mount fuel rail assembly 20 to the engine.

Transverse tubes 38 and 40 extend between the main tubes 22 and 24 at the left-hand ends of the tubes 22 and 24 as viewed in FIG. 1. Tube 38 delivers fuel to the two main tubes 22, 24 from an inlet tube 41 teed into tube 38. Tube 38 is not a single piece but rather comprises a metal nipple 42 teed into the side wall of tube 22 and a metal nipple 44 teed into the side wall of tube 24 and a flexible non-metallic tube 46 fitted over the free ends of the two nipples 42, 44. In similar fashion, tube 40 is not a single piece, but rather comprises a tubular nipple 48 teed into the side wall of tube 22, a tubular metal nipple 50 teed into the side wall of tube 24 and a flexible tube 52 fitted onto the free ends of nipples 48 and 50.

Figure 3:
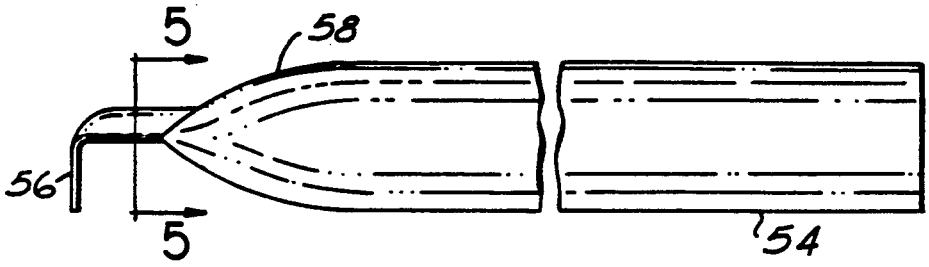
FIG. 3 is a plan view of one of the parts of the fuel rail in FIG. 1; specifically
Figure 4:
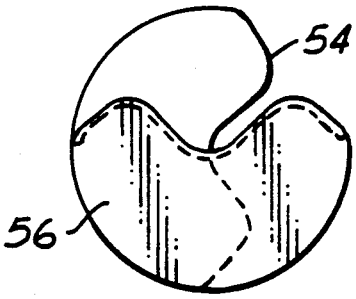
FIG. 4 is a left-hand end view of FIG. 3 on a slightly enlarged scale.
Figure 5:
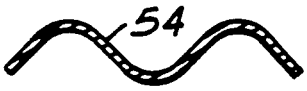
FIG. 5 is a transverse cross-sectional view on a slightly enlarged scale taken in the direction of arrows 5—5 in FIG. 3.
Figure 8:
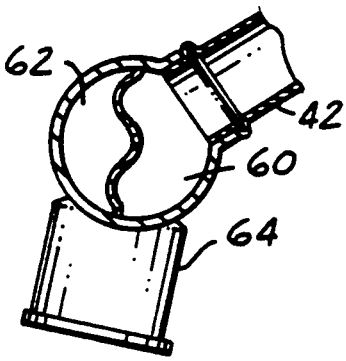
FIG. 8 is a partial cross-sectional view taken in the direction of arrows 8—8 in FIG. 1 and slightly enlarged.
Figure 9:
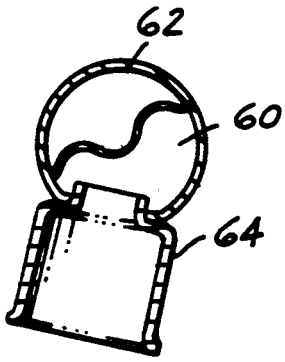
FIG. 9 is a cross-sectional view taken in the direction of arrows 9—9 in FIG. 1 and slightly enlarged.
Figure 10:
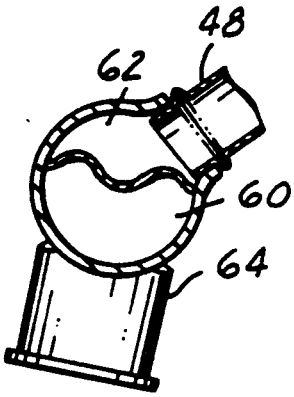
FIG. 10 is a partial cross-sectional view taken in the direction of arrows 10—10 in FIG. 1 and slightly enlarged.
Figure 11:
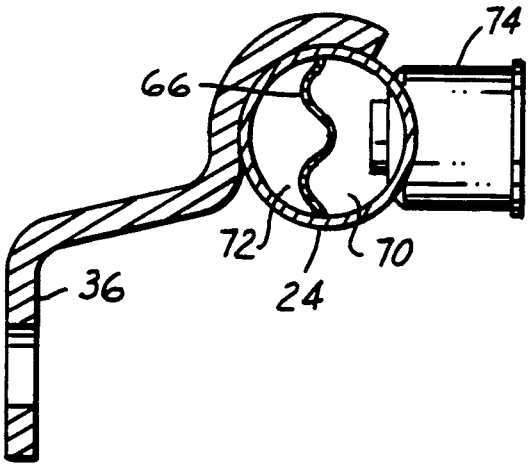
FIG. 11 is a cross-sectional view taken in the direction of arrows 11—11 in FIG. 1 and slightly enlarged.
Figure 12:
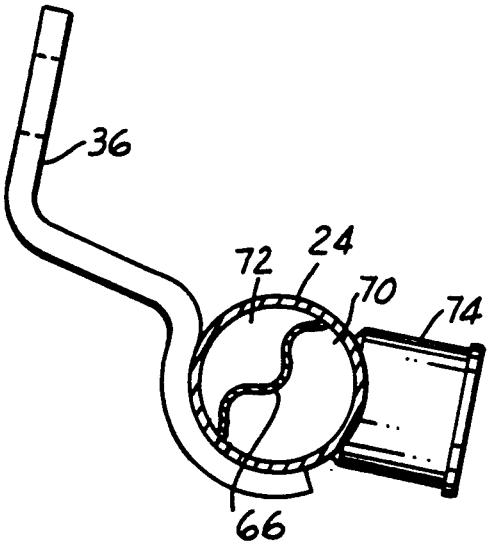
FIG. 12 is a cross-sectional view taken in the direction of arrows 12—12 in FIG. 1 and slightly enlarged.
Figure 13:
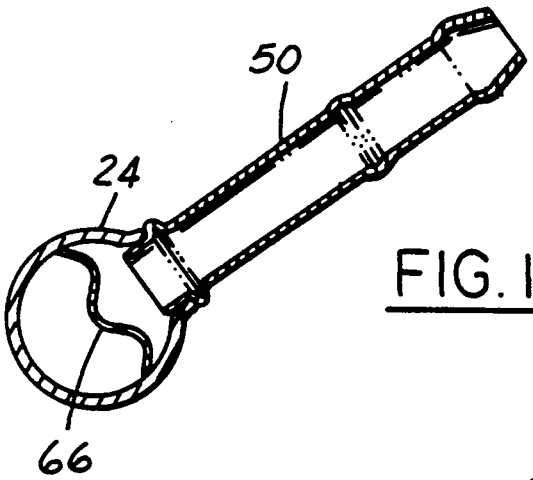
FIG. 13 is a partial cross-sectional view taken in the direction of arrows 13—13 in FIG. 1 and slightly enlarged.
Figure 14:
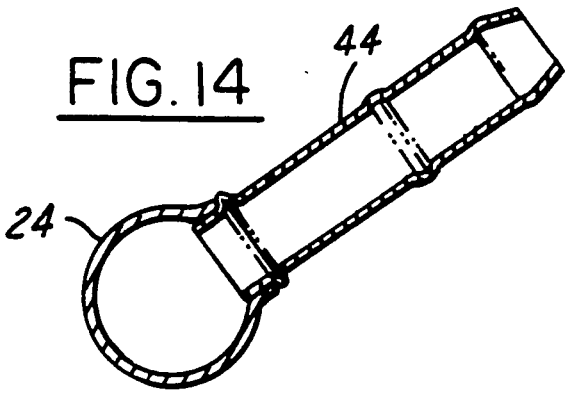
FIG. 14 is a partial cross-sectional view taken in the direction of arrows 14—14 in FIG. 1 and slightly enlarged.

FIGS. 3, 4 and 5 illustrate detail of a baffle 54 that is disposed within tube 22. Baffle 54 possesses the corrugated shape shown in FIG. 5 throughout its length except at one end, the left-hand end as viewed in FIG. 3 where it is formed with a transverse flange 56 having the shape that can be seen in FIG. 4. The baffle also contains a twist 58 which extends axially of tube 22 between nipples 42 and 48 when the baffle is assembled into tube 22. The twist is substantially constant but it has an extent of about 100° about the longitudinal axis of the baffle between nipples 42 and 48. As can be seen from FIGS. 8, 9 and 10, baffle 54 extends across a diameter of tube 22 to divide the interior of tube 22 into two flow channels designated 60 and 62. As can be seen from consideration of FIGS. 1 and 8, nipple 42 is in communication with the left-hand end of channel 60. Flange 56 is disposed just to the left of nipple 42 so that fuel that is introduced into tube 22 at nipple 42 cannot flow to the left but rather must flow to the right through flow channel 60. The twist 58 is in a clockwise direction from left to right in FIG. 1 as can be seen from comparison of FIGS. 8, 9 and 10. Accordingly, flow channel 60 similarly spirals in a clockwise sense, from left to right, in FIG. 1.

There are several injector cups, or connectors, 64 that are located in spaced apart relation along the length of tube 22. These cups are all in communication with flow channel 60. The cups are adapted to receive fuel injectors (not shown) so that fuel that is introduced into flow channel 60 is made available to the inlet to each fuel injector. In the example of fuel rail that is illustrated, there are three such injector cups 64 along each tube 22, 24.

As can be seen in FIG. 1, baffle 54 stops short of closure 26. Fuel that has passed through flow channel 60 can therefore pass around the right-hand end of the baffle to enter the right-hand end of flow channel 62 for flow in this channel from right to left. After having passed through flow channel 62, fuel enters the inlet to base 28 at the left-hand end of tube 22.

Figure 7:
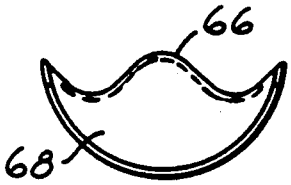
FIG. 7 is a left-hand end view of FIG. 6.
Figure 6:
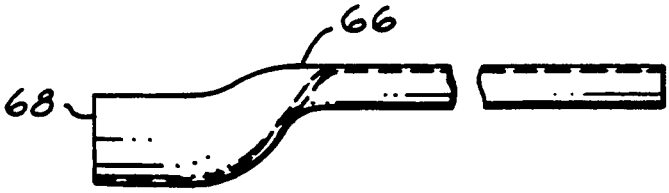
FIG. 6 is a plan view of another of the components used in the fuel rail of FIG. 1; specifically

FIG. 6 and 7 illustrate a baffle 66 that is disposed within tube 24. The respective ends of baffle 66 are spaced from the respective closure caps 32, 34. The left-hand end of the baffle is shaped to form a closure 68 that is disposed between nipples 44 and 50 when the baffle is assembled into tube 24.

Baffle 66 has a nominal cross-sectional shape throughout most of its length like that represented by FIG. 5. The baffle extends across a diameter of tube 24 to divide the tube into a first flow channel 70 and a second flow channel 72. The left-hand end of flow channel 70 is in communication with tube 38 so that fuel entering tube 24 via tube 38 will flow from left to right through flow channel 70 and thereby serve the three injector cups 74 that are in communication with flow channel 70 in the same manner as the injector cups 64 are in communication with flow channel 60. After having passed through flow channel 70, the flow reverses to enter the right-hand end of flow channel 72 and flow back through tube 24 within this flow channel to enter tube 40. Note that the left-hand end of this channel 72 is closed by flange 68 so that the fuel passing through this channel cannot reach the inlet end of the tube 24. The flow that has passed through flow channel 72 now passes through tube 40 to enter tube 22 and mix with the flow that has passed through flow channel 62. The confluence of the return flows enters the inlet of base 28 for the fuel pressure regulator.

In use, pressurized fuel is supplied at inlet 40 and the pressurized fuel is conveyed to the entrances of flow channels 60 and 70. The flow channels are thereby supplied with pressurized fuel which is made available to the fuel injectors that are attached to the cups 64 and 74. The return fuel passes through the flow channels 62 and 72 with the flow from channel 72 being carried across to the downstream end of channel 62 by transverse tube 40. It is at this point that the fuel is introduced to the inlet of the base 28. The pressure regulator functions to establish the desired fuel pressure level in the fuel rail.

It can be seen that the invention is advantageous for installations where the fuel inlet and outlet need to be located in proximity to each other. The invention is also adapted to fit conveniently onto the engine and although there are two flow channels along each side of the engine, these are contained within a single tube by virtue of the use of the internal baffle to divide the single tube into the two flow channels. The fuel rails and baffles are fabricated by conventional fabrication techniques of materials that are resistant to the corrosive effects of the typical fuels that are utilized in an internal combustion engine fuel system. Likewise, the flexible tubes 46 and 52 are also fabricated from materials that are highly resistant to the corrosive effects of fuel.

While a preferred embodiment of the invention has been disclosed and described, it is to be understood that principles of the invention are applicable to embodiments other than that specific embodiment which has been illustrated.

What is claimed is:

1. A fuel rail for an internal combustion engine fuel injection system comprising a main tube and a pair of further tubes that transversely intercept said main tube, a closure at an end of said main tube, a baffle extending axially within said main tube from the locations where said pair of further tubes communicate with said main tube toward, but stopping short of, said closure, said baffle dividing said main tube into two individual axially extending flow channels one of which extends from the point of communication of one of said further tubes with said main tube to the end of said baffle that stops short of said closure, and the other of which extends from the end of said baffle that stops short of said closure to communicate with the other of said further tubes, said baffle further comprising a second closure that closes the end of said one flow channel at a location along said main tube that is axially beyond said one further tube relative to said first-mentioned closure, the axial location of the point of communication of said other further tube with said main tube being nearer said first-mentioned closure than the location of communication of said one further tube with said main tube, said second closure also isolating said one flow channel from the other flow channel.

2. A fuel rail as set forth in claim 1 in which said baffle comprises a twist that lies between the locations where said two further tubes communicate with said main tube.

3. A fuel rail as set forth in claim 1 in which said two further tubes intercept said main tube at substantially the same circumferential location about said main tube.

4. A fuel rail as set forth in claim 3 in which said further tubes lie closely adjacent one another in the axial direction along said main tube.

5. A fuel rail as set forth in claim 4 in which said one further tube forms the inlet to the fuel rail and the fuel rail includes cups for connection of injectors to the fuel rail, said cups being disposed along said one flow channel.

6. A fuel rail as set forth in claim 5 further including the base of a pressure regulator at another end of said main tube in communication with said other flow channel.

7. A fuel rail as set forth in claim 1 including a second main tube containing a baffle, said baffle dividing the second main tube into its own first flow channel and its own second flow channel, said further tubes transversely intercepting said second main tube with said one further tube being in communication with said first flow channel of said second main tube and with said other further tube being in communication with said second flow channel of said second main tube.

8. A fuel rail as set forth in claim 7 in which said further tubes intercept said second main tube at substantially the same circumferential location on said second main tube and said two further tubes being closely adjacent one another at the locations where they intercept said second main tube.

9. A fuel rail as set forth in claim 8 in which the second main tube includes cups adapted to receive fuel injectors, said cups being in communication with said first flow channel of said second main tube.

10. A fuel rail as set forth in claim 9 including the base of a fuel pressure regulator having an inlet communicated with the downstream ends of the second flow channel of said second main tube and of said other flow channel of the first-mentioned main tube.

11. A fuel rail for an internal combustion engine fuel injection system comprising a main tube of circular cross-section containing a baffle of a corrugated cross-section that extends across a diameter of the main tube and divides the main tube into two flow channels, including a closure flange at one end of the baffle for closing one end of one of said flow channels, and a twist in the baffle closely adjacent said closure flange said baffle twist inducing corresponding twists in the two flow channels.

12. A fuel rail for an internal combustion engine fuel injection system comprising means defining two individual axially extending flow channels that are arranged side-by-side and share a common axial wall, communicating means communicating one end of one flow channel with a corresponding one end of the other flow channel such that fuel conveyed through said one flow channel in the direction toward said one end thereof will pass to said other flow channel at said one end thereof and flow therethrough in the direction away from said one end thereof, a pair of fuel inlets via which fuel is introduced to said flow channels from directions transverse thereto, one fuel inlet being a supply fuel inlet to said one fuel channel at a location that is axially distant from said one end thereof, and the other fuel inlet being a return fuel inlet to said other fuel channel at a location that is axially distant from said one end thereof, said fuel inlets being spaced apart from each other axially along said flow channels, closure means for axially terminating said one flow channel at an axial location therealong which lies axially beyond the locations of both said fuel inlets relative to said communicating means, return fuel outlet means from said other flow channel for conveying out of said other flow channel both return fuel that has entered via said return fuel inlet and fuel that becomes return fuel after having been conveyed from said supply fuel inlet through said one flow channel, through said communicating means and through said other flow channel, and wherein said two flow channels comprise twists that are disposed axially between said two fuel inlets and provide for desired circumferential placement of the locations of said fuel inlets.

13. A fuel rail as set forth in claim 12 wherein said twists are provided by a twist in said common axial wall.

14. A fuel rail as set forth in claim 12 wherein the locations of said fuel inlets are at substantially the same circumferential placement.

15. A fuel rail as set forth in claim 12 wherein said return fuel outlet means leads to a mounting for a fuel pressure regulator.

16. A fuel rail as set forth in claim 12 wherein said one flow channel contains means providing for the connection thereof to fuel injectors served by the fuel rail.

17. A fuel rail as set forth in claim 12 wherein said flow channels and said common wall are formed by a circular tube that is diametrically divided by a corrugated metal baffle.

18. A fuel rail as set forth in claim 17 wherein said closure means comprises a flange of said baffle.

19. A fuel rail for an internal combustion engine fuel injection system comprising means defining two individual axially extending flow channels that are arranged side-by-side and share a common axial wall, communicating means communicating one end of one flow channel with a corresponding end of the other flow channel such that fuel conveyed through said one flow channel in the direction toward said one end thereof will pass to said other flow channel at said one end thereof and flow therethrough in the direction away from said one end thereof, a pair of tubes that transversely intercept said flow channels, one tube intercepting said one flow channel at a location that is axially distant from said one end thereof, and the other tube intercepting said other flow channel at a location that is axially distant from said one end thereof, the locations at which said tubes intercept said flow channels being spaced apart from each other axially along said flow channels, closure means for axially terminating said one flow channel at an axial location therealong which lies axially beyond the locations of both said tubes relative to said communicating means, and wherein said two flow channels comprise twists that are disposed axially between said two tubes and provide for desired circumferential placement of the locations at which said tubes intercept said flow channels.

20. A fuel rail as set forth in claim 19 wherein said twists are provided by a twist in said common axial wall.

21. A fuel rail as set forth in claim 19 wherein the locations of said fuel inlets are at substantially the same circumferential placement.

22. A fuel rail as set forth in claim 19 including means communicating said other flow channel to a mounting for a fuel pressure regulator.

23. A fuel rail as set forth in claim 19 wherein said one flow channel contains means providing for the connection thereof to fuel injectors served by the fuel rail.

24. A fuel rail as set forth in claim 19 wherein said flow channels and said common axial wall are formed by a circular tube that is diametrically divided by a corrugated metal baffle.

25. A fuel rail as set forth in claim 24 wherein said closure means comprises a flange of said baffle.

26. A fuel rail for a V-type internal combustion engine comprising a pair of fuel rail sections for disposition on opposite sides of a V-type engine, each fuel rail section comprising means defining two individual axially extending flow channels that are arranged side-by-side, communicating means communicating one end of one flow channel of each fuel rail section with a corresponding one end of the other flow channel of the same fuel rail section, fuel supply conduit means for introducing supply fuel into said one flow channel of said one fuel rail section at an axial location that is distant from said one end thereof and into said one flow channel of said other fuel rail section at an axial location that is distant from said one end thereof so that in each fuel rail section fuel will flow through said one flow channel thereof toward said one end thereof, then through said communicating means thereof, and then through said other flow channel thereof in the direction away from said one end thereof, further conduit means communicating said other flow channel of one of said fuel rail sections with said other flow channel of the other of said fuel rail sections, said one fuel rail section having the flow channels thereof sharing a common axial wall and having closure means axially terminating said one flow channel thereof at a location therealong that is axially beyond the locations at which both said conduit means communicate with said one fuel rail section relative to said communicating means thereof, said further conduit means and said supply fuel conduit means both approaching said one fuel rail section from the general direction of said other fuel rail section.

27. A fuel rail as set forth in claim 26 wherein said flow channels of said one fuel rail section comprise twists between the location along said one fuel rail section at which said supply fuel conduit means communicates with said one fuel rail section and the location along said one fuel rail section at which said further conduit means communicates with said one fuel rail section, and wherein said one flow channel of said one fuel rail section contains means providing for the connection thereof to fuel injectors served by said one fuel rail section.

28. A fuel rail as set forth in claim 27 wherein said flow channels and said common axial wall of said one fuel rail section are formed by a circular tube that is diametrically divided by a corrugated baffle.

29. A fuel rail as set forth in claim 28 wherein said closure means comprises a flange of said baffle.

30. A fuel rail as set forth in claim 27 including means communicating said other flow channel of said one fuel rail section with the base of a fuel pressure regulator that disposed on said one fuel rail section axially beyond said closure means thereof relative to the location at which said supply fuel conduit means communicates with said one fuel rail section.

31. A fuel rail for an internal combustion engine fuel injection sytem comprising a main tube of circular cross-section containing a baffle of a corrugated cross-section that extends across a diameter of the main tube and divides the main tube into two flow channels, and a twist in the baffle that induces corresponding twists in the two flow channels.

* * * * *